US006668896B1

(12) United States Patent
Granero Tormo

(10) Patent No.: US 6,668,896 B1
(45) Date of Patent: Dec. 30, 2003

(54) DEVICE FOR APPLYING LABELS

(76) Inventor: Ricardo Granero Tormo, Villa de Madrid, 13, Poligono Industrial Fuente del Jarro, E-46988 Paterna (ES)

( * ) Notice: Subject to any disclaimer, the term of this patent is extended or adjusted under 35 U.S.C. 154(b) by 0 days.

(21) Appl. No.: 10/069,684

(22) PCT Filed: Jul. 27, 2000

(86) PCT No.: PCT/ES00/00282

§ 371 (c)(1),
(2), (4) Date: Feb. 22, 2002

(87) PCT Pub. No.: WO01/14211

PCT Pub. Date: Mar. 1, 2001

(30) Foreign Application Priority Data

Aug. 24, 1999 (ES) ..... P 9901932

(51) Int. Cl.[7] ..... B65C 9/28; B65C 9/26

(52) U.S. Cl. ..... 156/556; 156/541; 156/542; 156/497; 156/DIG. 38

(58) Field of Search ..... 156/541, 497, 156/542, 556, DIG. 38, 356, 361, 540, DIG. 37, DIG. 33, DIG. 45; 251/63

(56) References Cited

U.S. PATENT DOCUMENTS 3,645,832 A * 2/1972 Sauer ..... 156/541
3,806,395 A * 4/1974 French ..... 156/497
4,556,443 A * 12/1985 Moya ..... 156/356
4,581,094 A * 4/1986 Sato ..... 156/352
4,612,076 A * 9/1986 Moss ..... 156/249
5,885,406 A 3/1999 Tiefel
5,971,051 A * 10/1999 Crankshaw ..... 156/541

FOREIGN PATENT DOCUMENTS

EP 0663342 AI 7/1995
EP 0908390 AI 4/1999

* cited by examiner

*Primary Examiner*—Richard Crispino
*Assistant Examiner*—Sue A. Purvis
(74) *Attorney, Agent, or Firm*—Cowan, Liebowitz & Latman, P.C.; Mark Montague

(57) ABSTRACT

A device for applying labels includes a roller that carries a tape that includes plural labels that run along a guide-wedge that produces a change in direction that produces the detachment of the labels. A head is connected to a suction circuit and to a blower device, whose operation are governed by a pneumatic distributor, so that when the label is detached from the tape, suction is produced so that the label is retained at the head. The label then is blown to project it energetically over the surface of a product on which it is adhered by the action of the impulsion. The head has a homogeneously multiperforated surface that facilitates the homogenous impulsion of the label.

5 Claims, 2 Drawing Sheets

DEVICE FOR APPLYING LABELS

OBJECT OF THE INVENTION

The invention in question refers to a device for applying labels. Its purpose is to provide greater speed in labelling, and to increase the efficiency of the marking line.

The purpose of the invention is furthermore to make the labelling without the applicator devices coming into contact with the surface of the product that is to be labelled, and to prevent the product from suffering any kind of damage in the labelling.

The invention can be applied to the labelling of food products, preferably fruit, but it can obviously be used in any kind of product that needs to be labelled.

BACKGROUND OF THE INVENTION

A close state of the art to the invention in question is made up of the Patent of Invention P-9601222 whose owner is the same as the owner of the present invention, and it describes a device that will allow the automatic sticking of labels that are adhered on a longitudinal strip of waxed paper that determines a roll and that furthermore counts on a motor that performs the unwinding of the waxed paper. This waxed paper runs across a circuit that includes a guide-wedge making it possible for the waxed paper to change direction brusquely causing the labels to be detached from it. The labels are thus left in a condition to be adhered to the surface to be marked by means of a dual effect cylinder that is finished off at the bottom by an applicator whose surface in contact with the label is slightly concave. The label is retained on this cylinder by effect of the traction produced by the static electricity on the labels when rubbing against the rollers, after separating the labels. All of this is performed so that by means of a photocell, the pass of the product to be marked is detected, activating the dual effect cylinder until the applicator comes in contact with the surface to be marked on which the label is stuck.

This type of device presents the inconvenience that the speed of marking is limited by the label application device, and also this needs to be in contact with the product to be marked, such that the surface could suffer damage. This is more likely to occur in the labelling of food products.

In order to avoid any contact between the label application device and the product to be marked, EP-A-0908390 and U.S. Pat. No. 5,885,406 disclose a device for applying labels comprising an applicator surface provided with a plurality of openings through which a suction is established to retain the label (once detached from the label strip) and through which pressurized air is delivered to propel the label towards an article to be marked.

DESCRIPTION OF THE INVENTION

The invention has developed a new device for applying labels that embodies a roll of tape to which a plurality of labels are adhered, that are aligned longitudinally. The invention furthermore has means that cause the label to become detached from the tape, and it has means for applying the labels on the product to be marked. The tape is unwound by a motor that activates drive rollers and a tape winding recovery roller after the labels are detached. It is characterized in that the means for applying the label are made up of suction means of the detached label, by retention means of that detached label, and by blowing means of the retained label, so that these blowing means energetically project the label over the surface of the product to be marked on which it is stuck without there being contact between the application means of the label and the labelled product, which represents a big advantage. This advantage is more desirable when it is obtained in the case when the surface of the product to be marked does not have a certain degree of solidity, as occurs with products such as fruit, or food products in general.

The means for withholding the detached label include a head through which the suction is applied to retain the sticker, and through which the blowing is also applied on the retained sticker to make it stick on the surface of the product.

In a preferable execution, the head has a homogeneously multiperforated surface, through the perforations of which the suction and blowing air flows, so that the air flow is broken down into numerous push and absorption points, that are evidently distributed homogeneously, making a correct absorption of the label, and it also has an absolutely flat projection.

Another characteristic of the invention lies in the fact that a pneumatic distributor has been foreseen that is controlled electronically to govern the suction function and the projection function of the label.

The suction means include a suction circuit that is connected to the head and to the pneumatic distributor.

In addition, the blowing means have a fast release valve, that feeds the head, and whose operation is controlled by the pneumatic distributor.

The blowing means also have a pressure accumulator that is connected to the fast release valve to provide additional pressure to the head and to impel the label with suitable force against the surface of the product to be marked.

The invention device is fitted on a support that can be regulated according to shafts X and Y to facilitate the labelling of a plurality of food products that occupy a certain surface, so that a wider area can be labelled, for example a box of fruit.

To facilitate a better understanding of this description and forming an integral part of it, a number of figures are included that represent the purpose of the invention by an illustrative and non-restrictive way.

DESCRIPTION OF AN EXAMPLE OF EXECUTION OF THE INVENTION

Figure 1:
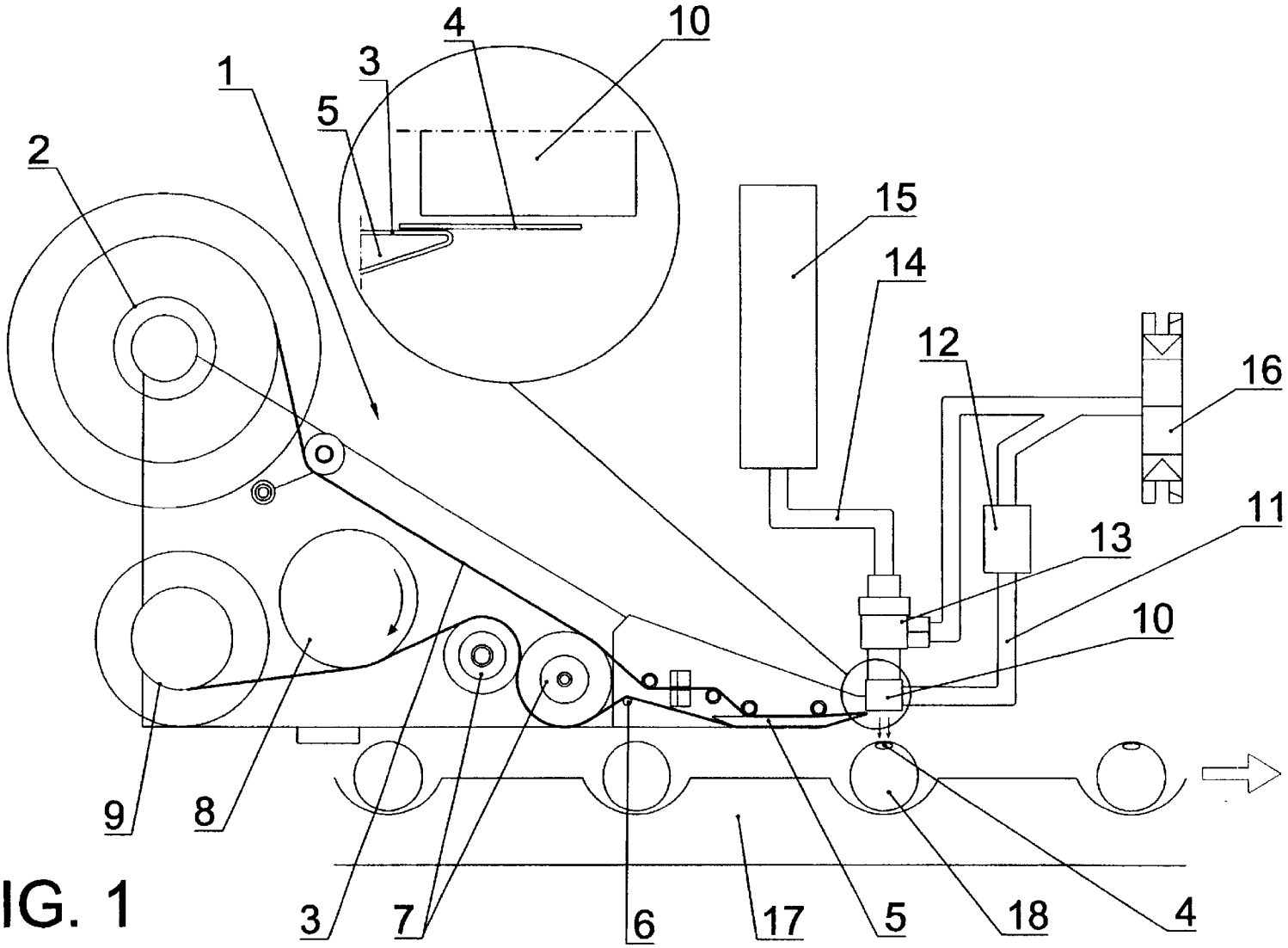
FIG. 1.—Shows a schematic front view of the label applicator device of the invention. It also shows the detail of how the label is detached to facilitate its suction.
Figure 2:
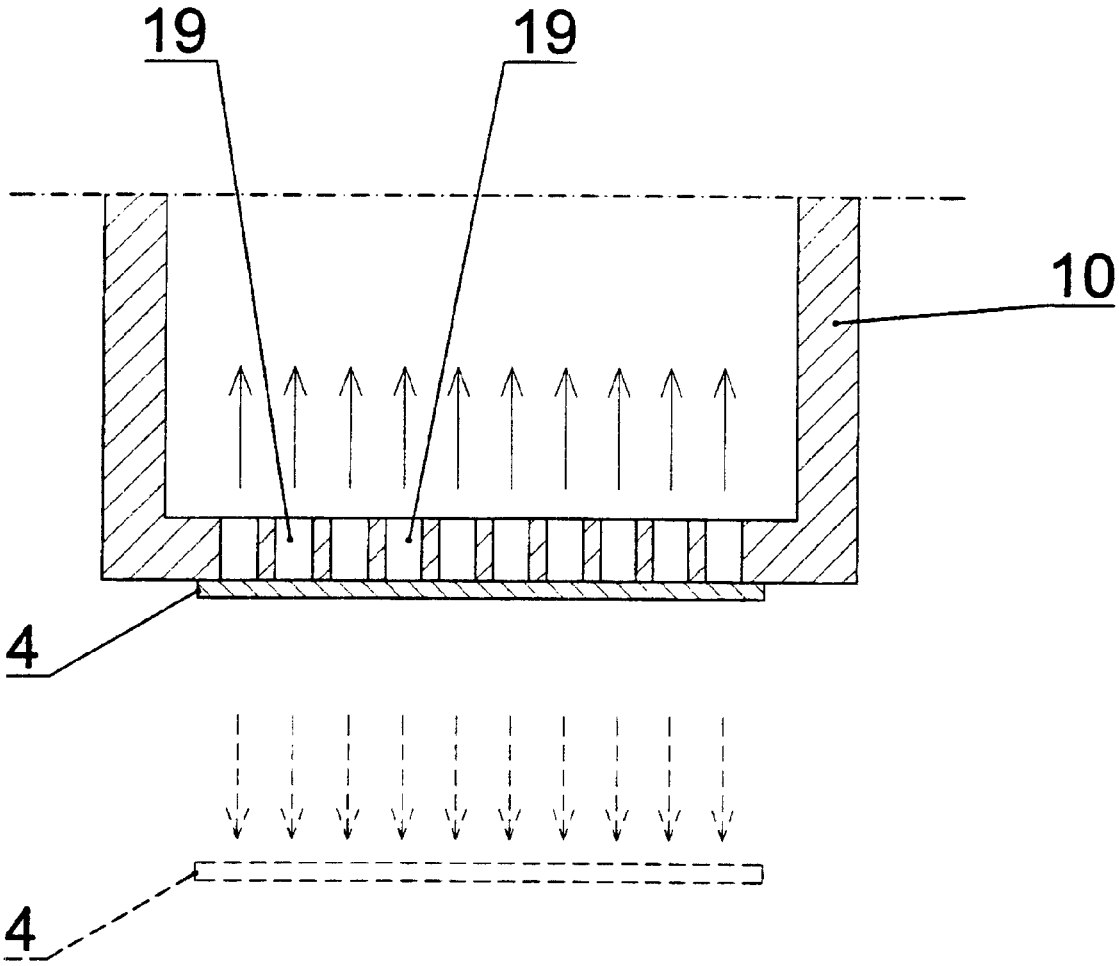
FIG. 2.—Shows a schematic sectioned view of a possible example of execution of the head that forms part of the device that is the purpose of the invention.

A description follows showing an invention based on the figures discussed above.

The label applicator of the invention comprises a frame 1 in which a roll-holder shaft 2 is included that retains a roll of tape 3 of waxed paper that comprises a support for a plurality of self-adhesive labels 4 of plastic material or by-products, that are aligned longitudinally on the tape 3.

A guide-wedge 5 has been provided on frame 1 along which the tape 3 passes, that turns round at the end of the guide-wedge 5, passing over a roller 6 that leads the tape without labels 4, to drive rollers 7 to come out on the recovery roller 9. To obtain this functionality, frame 1 also supports the motor 8 that produces the drag movement of the tape 3 in the manner described above.

The process for unsticking the labels 4 can be executed in the manner described in the Patent nº P-9601222 cited in section of Antecedents of the Invention, or in any other manner, because this unsticking does not constitute the purpose of the invention.

The novelty and purpose of the invention is focused on the device that includes a head 10 that by means of a conduit 11 is connected to suction circuit 12.

In addition, the head 10 is connected to a quick release valve 13 that by means of a conduit 14 is connected to a pressure accumulator 15.

Furthermore the quick release valve 13 and the suction circuit 12 are connected to a pneumatic distributor 16, that is electronically controlled to govern the working of the quick release valve 13 and of the suction circuit 12, as will be described later.

The head 10 is made up of a homogeneously multiperforated surface 19 to facilitate the operation described below.

Based on the described structure, it can be easily understood that when a label 4 is almost detached from the tape 3, this label 4 lies facing and near the multiperforated surface 19, so that if under this circumstance, the pneumatic distributor 16 activates the suction circuit 12, an inlet of air flow is produced through the perforations of the head 10, such that label 4 is absorbed and is retained on the multiperforated surface 19. The suction effect can also be used to help detach the label.

In this situation, when the pass of a product 18 is detected, for example an apple moving along a conveyor belt 17, the pneumatic distributor 16 activates the quick release valve 13, that through the pressure accumulator 15 produces a blast of air that projects the sticker 4 on the surface of the product 18, thus sticking the label 4 on the surface of that product 18.

This operation is favoured by the fact that the orifices of the multiperforated surface 19 are distributed homogeneously, so that the flow of air is broken up into numerous push points distributed homogeneously so that the label is projected completely flat.

Consequently the electronic control is connected to the corresponding sensors that detect the presence of the label 4 and the product 18 to be marked for controlling the correct working of the pneumatic distributor 16 materialised in an electro-valve.

Although it is not shown in the figures, the device described can be fitted on a support that allows it to be a larger labelling surface, as for example the case of labelling fruit stacked up in boxes.

What is claimed is:

1. A device for applying labels, comprising:

a roll of tape that supports a plurality of aligned longitudinally labels;

means that produce a detachment of the labels from the tape;

application means for applying the labels to a product to be marked, which comprise: suction means of the detached label, retention means where the detached label is held by said suction means, and blowing means of the detached and retained label;

a motor that drives drive rollers to unwind the tape; and a recovery roller for winding the tape once the labels have been detached;

the blowing means including a pressure accumulator to provide additional pressure to energetically project the label to a surface of a product to be marked, such that the label is stuck on said surface, the blowing means also including an electronically controlled pneumatic distributor to control the suction and projection of the label, and a quick release valve controlled by the pneumatic distributor to provide a quick release of pressurized air accumulated by the pressure accumulator so that the label is projected towards the surface of the product to be marked.

2. The device for applying labels according to claim 1, wherein the retention means includes a head through which the suction is applied to retain the label, and through which the blowing of the retained label is also applied to perform the sticking on the surface of the product.

3. The device for applying labels according to claim 2, wherein the head includes a homogeneously multiperforated surface, through which perforations passes the suction-blowing air, so that the projection of the label is made completely flat because the air flow is discomposed in numerous thrust points distributed homogeneously.

4. The device for applying labels according to claim 1, wherein the suction means is determined by a suction circuit that is connected to the head and to the pneumatic distributor.

5. The device for applying labels according to claim 1, further comprising a support with a regulation which permits to shift said device along a first axis (X) and along to a second axis (Y).

* * * * *